US005873656A

United States Patent [19]

Arkins et al.

[11] Patent Number: 5,873,656

[45] Date of Patent: Feb. 23, 1999

[54] STRAW-ACCESS SYSTEM FOR FLEXIBLE BEVERAGE POUCH

[75] Inventors: Thomas Daniel Arkins, Ridgefield, Conn.; Panagiotis Kinigakis, West Windsor, N.J.

[73] Assignee: Kraft Foods, Inc., Northfield, Ill.

[21] Appl. No.: 861,348

[22] Filed: May 21, 1997

[51] Int. Cl.[6] ..... B65D 33/00

[52] U.S. Cl. ..... 383/202; 229/204; 383/5

[58] Field of Search ..... 383/202, 5, 208; 229/103.1, 204

[56] References Cited

U.S. PATENT DOCUMENTS

| | | | |
|---|---|---|---|
| 3,272,424 | 9/1966 | Rodkey | 383/208 |
| 3,687,358 | 8/1972 | Wink et al. | 383/208 |
| 4,072,233 | 2/1978 | Kramer et al. . | |
| 4,553,693 | 11/1985 | Terajima et al. . | |
| 4,762,514 | 8/1988 | Yoshida et al. . | |
| 4,858,766 | 8/1989 | Tsai . | |
| 5,052,614 | 10/1991 | Xuan . | |
| 5,425,583 | 6/1995 | Wild . | |

FOREIGN PATENT DOCUMENTS

| | | | |
|---|---|---|---|
| 2814008 | 10/1978 | Germany | 383/202 |

*Primary Examiner*—Jes F. Pascua

*Assistant Examiner*—Robin A. Hylton

*Attorney, Agent, or Firm*—Thomas R. Savoie; Thomas A. Marcoux

[57] ABSTRACT

An easy-open beverage container and an opening system for the beverage container are provided which include a container barrier wall having a straw hole. An easy-open tamper-evident membrane seal is located inside of the container and sealingly covers the straw hole. This membrane seal includes an outer portion which is sealed to an inside surface of the barrier wall about the straw hole and which terminates at a distance from the straw hole. This outer portion includes fingers which extend toward the straw hole. The membrane seal also includes an inner portion integral with the outer portion which is not sealed to the inside surface and which covers the straw hole so that in use the straw pierces the inner portion after being inserted into the straw hole. Preferably, the fingers form a sinusoidal intersection of the inner and outer portions, and the inner and outer portions as well as the straw hole are concentric. In addition, the membrane seal is formed of a laminate of LLDPE-EVOH-LLDPE suitably laminated together, as by tie layers, with the EVOH less than 40% of the thickness of the laminate and each LLDPE is at least 30% of the thickness of the laminate. The distance is greater than about ⅓ the diameter of the straw and less than about 1 ⅔ the diameter of the straw, and the inner portion has a minimum edge to edge spacing of at least three times the diameter of the straw.

20 Claims, 1 Drawing Sheet

STRAW-ACCESS SYSTEM FOR FLEXIBLE BEVERAGE POUCH

FIELD OF THE INVENTION

The present invention relates generally to beverage containers which have an opening through which the beverage is consumed through a straw, and more particular to a pouch or bag-shaped beverage container having an opening system which is pierced by a straw to access the beverage.

BACKGROUND OF THE INVENTION

In pouch or bag-shaped beverage containers having a membrane seal which is to be pierced by a pointed straw, there is a problem making the seal sufficiently easy for the consumer to pierce with a straw. The piercing of the membrane seal may be an especial problem for small children who frequently utilize such containers and who lack the dexterity of adults.

In one prior art opening system a simple membrane seal has been used on an inside surface of one barrier wall of a bag-shaped container. The membrane seal is sealed up to the edges of the straw hole in the barrier wall near a top of the container. The membrane is flush with the inner surface of the barrier wall and the membrane area covering the straw hole is essentially unyielding. Such a membrane seal is disclosed in U.S. Pat. No. 5,425,583 (Wild). While such a membrane seal is an improvement of present commercial opening systems it is often difficult for young children (ages 4–9) to use since the membrane must be struck with the straw only in the hole in the barrier wall and at the same time with somewhat of a downward angle so that the straw does not pierce as well the back barrier wall of the container. In addition, once (and as) the membrane is pierced, the membrane is torn and squeezing of the bag-shaped container may result in the beverage being pushed up around the outside of the straw and out of the straw hole causing undesired spillage.

Another opening system using two distinct membrane seals for a bag-shaped container is disclosed in U.S. Pat. No. 4,553,693 (Terajima et al.). A first membrane seal is attached on the inside surface of the barrier wall about the straw hole and to a tamper-evident, pealable tab attached to an outer surface of the barrier wall. Covering the first membrane and attached to the inside surface about the first membrane is a second membrane which is at least partially pierced. When the tab is peeled from the barrier wall, the part of the first membrane covering the straw hole is also pealed away therewith. This exposes the second membrane which is easily pierced by the straw, as it is already at least partially pierced. However, such opening systems are complex and expensive.

SUMMARY OF THE INVENTION

In accordance with the present invention, a simple and inexpensive easy-open and tamper-evident beverage container and in particular an opening system for the beverage container is provided which include a container barrier wall having pre-punched a straw hole therein through which a straw is designed to be inserted to draw the beverage from the container. A easy-open, tamper-evident membrane seal is located inside of the container and sealingly covers the straw hole. This membrane seal is liquid impervious and includes an outer portion which is sealed to an inside surface of the barrier wall about the straw hole, which outer portion terminates at a distance from the straw hole. This outer portion includes fingers which extend toward the straw hole. The membrane seal also includes an inner portion integral with the outer portion which is not sealed to the inside surface and which covers the straw hole so that in use the straw pierces the unsealed, inner portion after being inserted into the straw hole.

The fingers present in the outer portion create an unsealed inner portion which can be described as flower-shaped. As shown in the drawings, the fingers are illustrated as being arc-shaped; however, the shape of the fingers could be pointed, rectangular or the like. Typically the fingers will be uniformly arranged about the inner periphery of the sealed area and create unsealed areas between adjacent fingers which replicate the shape of the fingers. In a preferred embodiment, the fingers form a sinusoidal intersection of the inner and outer portions about a center of the inner portion. In addition, the outer portion is substantially circular and the inner portion is centered in the outer portion. Further, the inner portion is substantially centered about the straw hole which is also circular.

In the preferred embodiment, the membrane seal is formed of a laminate of LLDPE-EVOH-LLDPE (linear low density polyethylene—ethylene vinyl alcohol—linear low density polyethylene) suitably laminated together, as by tie layers. In addition, the EVOH is less than 40% of the thickness of the laminate, each LLDPE is at least 30% of the thickness of the laminate, and the thicknesses of any optional tie layers is negligible.

In a particularly preferred embodiment, the distance between the edge of the straw hole and the fingers of the sealed outer portion is greater than about ⅓ the diameter of the straw and less than about 1⅔ the diameter of the straw. With this distance, any piercing of the unsealed inner portion by a straw is always visible, making the membrane seal tamper-evident. In addition, the unsealed inner portion has a minimum edge to edge spacing taken along a line drawn through the center of the straw hole of at least about three times the diameter of the straw.

It is an advantage of the present invention that an easy-open beverage container is provided which is readily pierced with a straw by young children and which does not cause inadvertent spillage of the liquid contents or piercing of the back barrier wall of the beverage container by the straw. With the opening system of the present invention it would be possible to utilize a conventional, unpointed straw to piece the membrane seal. This is a safety benefit with use by young children.

It is an advantage of the present invention that placement of the straw in the straw opening of the beverage container prior to piercing the membrane seal is facilitated by movement of the unsealed, inner portion of the membrane seal away from the straw hole.

It is a further advantage of the present invention that the shape of the unsealed inner portion permits increased movement and stretching of in the inner portion about the straw as the straw is pushed through the membrane seal. This results in a tight fit of the ruptured membrane seal about the straw. This tight fit of the ruptured membrane seal serves to hold the straw in place during use (to keep the straw from falling into the beverage container inadvertently) as well as to prevent the beverage inside of the beverage container from being pushed up around the straw during piercing as well as during use.

It is still another advantage of the present invention that the area of the accessible portion of the unsealed, inner portion of the membrane seal is limited by the fingers of the sealed outer portion so that any tampering or piercing of the inner portion is readily viewed through the straw hole, making the opening system tamper-evident.

It is yet another advantage of the present invention that the opening system requires only one step using only a little force to pierce the inner portion of the membrane seal, making the opening system easier to use.

Other features and advantages of the present invention are stated in or apparent from detailed descriptions of presently preferred embodiments of the invention found hereinbelow.

DESCRIPTION OF THE PREFERRED EMBODIMENTS

Figure 1:
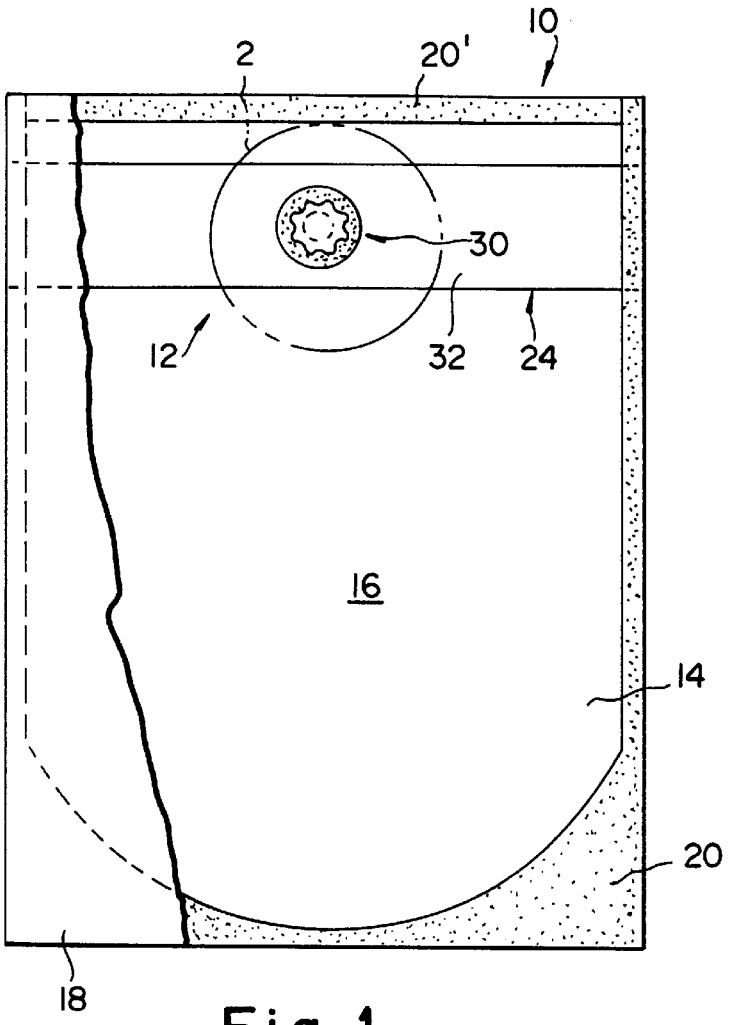
FIG. 1 is a rear elevation view of a beverage container of the present invention with the majority of the back wall of the container cut away to show the membrane seal.

With reference now to the drawings in which like numerals represent like elements throughout the views, an easy-open and tamper-evident beverage container 10 including an opening system 12 according to the present invention is depicted in FIG. 1. Beverage container 10 is an improvement to the beverage container and in particular to the opening system disclosed U.S. Pat. No. 5,424,583 noted above which is hereby incorporated by reference. Beverage container 10 includes a first or front barrier wall 14 having an inside surface 16 and a second or back barrier wall 18 shown mostly cut away for clarity. As appreciated by those in the art, barrier walls 14 and 18 are attached together by a suitable adhesive or heat sealed layer 20 depicted by stippling along the peripheral edges of the two lateral sides and bottom as shown prior to filling. Beverage container 10 is then filled through the open top, and the top edges are then similarly attached together with a similar layer 20'. As also appreciated by those in the art, barrier walls 14 and 18 are suitably formed as a sealing foil, either a mono-material or a multi-layer compound material which are well known.

Opening system 12 includes a straw hole 22 punched or otherwise provided near the top of front barrier wall 14. Straw hole 22 is provided so that a straw 23 (depicted only in part in FIG. 4) provided with beverage container 10 can be easily inserted therethrough in order for the consumer to suck the beverage from beverage container 10 (after filling and sealing of the top). In order to cover and seal straw hole 22 until use by a consumer, opening system 12 includes a seal strip 24. Seal strip 24 is attached across the top of beverage container 10, such as by having the longitudinal ends thereof trapped between the attached edges of the two lateral sides of front barrier wall 14 and back barrier wall 18. Seal strip 24 is composed of three integral sections, an inner portion 26 and an outer portion 28 which together comprise a basic membrane seal 30, and a mounting portion 32 used during the forming of membrane seal 30. Conveniently, seal strip 24 is provided from a continuous reel for attachment to front barrier wall 14.

As shown by stippling, outer portion 28 is suitably attached by a heat seal 34 or otherwise securely attached to inside surface 16 of front barrier wall 14, which inner portion 26 is not attached to inside surface 16. It will be particularly noted that heat seal 34 forms a series of small fingers 36 in outer portion 28 which extend toward the center of straw hole 22. Conveniently, fingers 36 are laid out so that inner portion 26 and outer portion 28 form a sinusoidal intersection as shown centered around inner portion 26.

In the preferred embodiment of the present invention, straw hole 22 is preferably circular, with inner portion 26 then being ideally centered about the center of straw hole 22 and outer portion 28 also having an outer circular shaped likewise centered about inner portion 26 and hence straw hole 22. However, it will be noted that outer portion 28, and in particular fingers 36, terminate a distance D from straw hole 22. With this construction, inner portion 26 forms a small pouch 38 beneath straw hole 22 and the surrounding part of front barrier wall 14. Precise centering of inner portion 26 and outer portion 28 about straw hole 22 will be dependent upon the precision with which the action of a heat sealing tool is registered with pre-punched straw hole 22.

Figure 3:
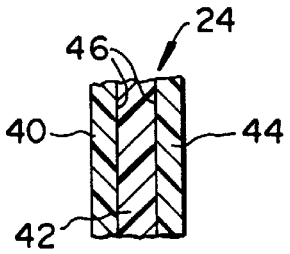
FIG. 3 is an enlarged cross-sectional side elevation view of a portion of the membrane seal depicted in FIG. 2.
Figure 2:
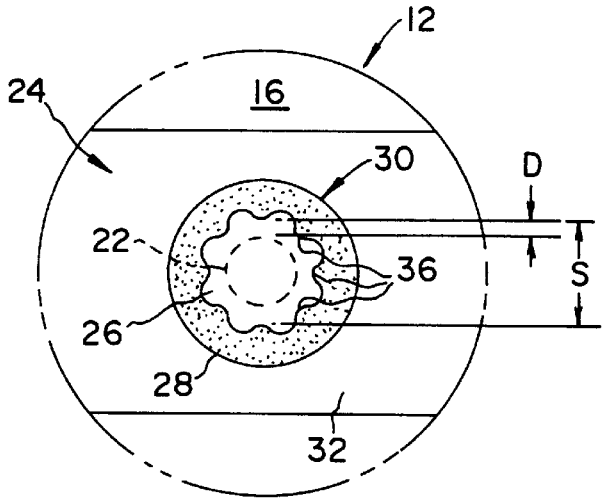
FIG. 2 is an enlarged view of that part of the beverage container including the membrane seal circled with a broken line identified with the number 2 in FIG. 1.

A suitable construction of seal strip 24 and hence of membrane seal 30 is depicted in FIG. 3. As shown, membrane seal 30 is formed as a laminate of an LLDPE (linear low density polyethylene) layer 40, an EVOH (ethylene vinyl alcohol) layer 42, and another LLDPE 44 suitably attached or laminated together as by (optional) tie layers 46. Preferably, membrane seal 30 has an overall thickness of about 40 microns (0.00157"), with the EVOH layer 42 less than about 40% of the thickness and LLDPE layers 40 and 44 at least 30% each of the thickness (with the thickness of any tie layers 46 being negligible). With this construction, straw 23 is able to pierce membrane seal 30 easily and smoothly, with inner portion 26 stretching and distending (thinning) before being ruptured by straw 23 as explained in greater detail subsequently. This laminate functions better than low-density polyethylene/EVOH/low-density polyethylene laminate found to be present in the commercial embodiment of the aforementioned Wild patent.

In practice, it is often difficult to precisely center inner portion 26 on straw hole 22 of front barrier wall 14 when sealing jaws are used to seal outer portion 28 to inside surface 16. Rather, the position of seal strip 24 and hence of inner portion 26 may differ by about ±2 mm. Therefore, in the preferred embodiment, the distance D at any location is greater than about ⅓ the diameter of straw 23 and less than about 1⅔ the diameter of straw 23 (but always less that twice the diameter), and inner portion 26 then has an (minimum) edge to edge spacing S (taken along a line drawn through the center of straw hole 22) of at least three times the diameter of straw 23. Within these constraints, it will also be appreciated that the width of seal strip 24 should also be minimized to conserve material. A suitable straw hole diameter for beverage container 10 is 5 mm and a suitable straw diameter for use with such a straw hole is 3.5 mm. Suitable dimensions for opening system 12 further include: width of seal strip 24, about 16.5 mm; diameter of outer portion 28, about 13.5 mm; height (trough to peak) of fingers 36, at least 1.75 mm, preferably at least 2.0 mm and most preferably from 2.0–3.5 mm. Distance D is preferably about 3.25 mm; and spacing S is preferably about 11.5 mm.

Figure 4:
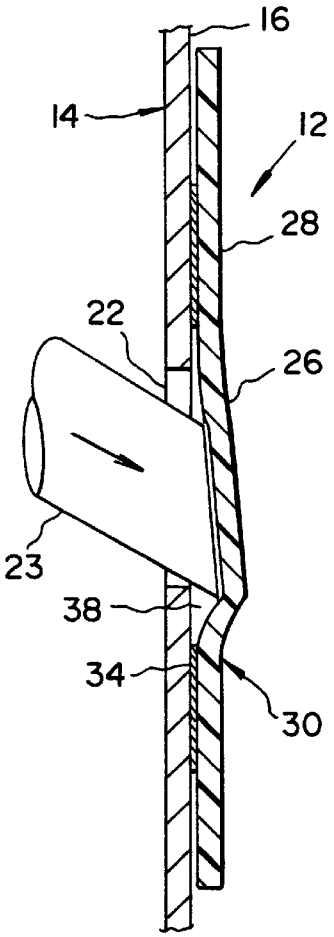
FIG. 4 is a cross-sectional side elevation view of the membrane seal depicted in FIG. 2 as a straw is being inserted therethrough.

In use, as shown in FIG. 4, straw 23 is first easily inserted into straw hole 22 of (filled and sealed) beverage container 10 as shown by the arrow. Because outer portion 28 of membrane seal 30 does not extend to the edges of straw hole 22, inner portion 26 forms small pouch 38 which readily moves away from the straw hole 22 and elongates or distends when contacted by straw 23. Therefore, as shown in FIG. 4, straw 23 readily enters straw hole 22. Thereafter, straw 23 does not slip out of straw hole 22 once straw hole 22 is entered, and straw 23 is guided by straw hole 22 during further entry as shown by the resting of straw 23 against the edge of straw hole 22.

While straw 23 has been depicted with the slightly pointed end, it will be appreciated that the pointed end could be eliminated. The edge of straw hole 22 serves to guide straw 23 during further entry. It will also be appreciated that any portion of the edge of straw hole 22 besides the lowermost part can suitably guide straw 23 and it is only for convenience (and as will typically but not necessarily occur) that straw 23 is depicted as being guided by the lowermost part of the edge of straw hole 22. This guiding action of straw hole 22 due to the presence of small pouch 38 also allows for steeper puncture angles (angled more down into beverage container 10) and the tendency of straw 23 to slip out of straw hole 22 is greatly reduced, which makes it easier to insert straw 23 into beverage container 10 without fear of piercing back barrier wall 18 or interference with back barrier wall 18.

As straw 23 is further pushed against inner portion 26, stretching/distending and eventual rupture of the seal strip laminate 24 occurs. The flower-shaped pouch 38 created by unsealed inner portion 26 and fingers 36 of sealed outer portion 28, coupled with the laminate structure of the seal strip 24 permits smooth insertion of the straw. The force needed to first stretch seal strip 24, then rupture the stretched seal strip and finally to continue to pass the straw through the ruptured seal strip and into beverage container 10 is relatively low and relatively constant. As a result, the consumer, who typically holds beverage container 10 in one hand while using the other hand to insert the straw, is not inclined to squeeze beverage container 10 during insertion of the straw. This contrasts with opening the container depicted in U.S. Pat. No. 5,425,583 which, in the absence of an unsealed inner portion 26, requires a relatively larger force to break through the relatively rigid seal strip laminate and a much reduced force once a rupture is created. The relatively large initial force coupled with a rapid drop off in force causes the consumer to squeeze the container which forces liquid up around the outside surface of the straw resulting in spillage of the liquid product. The presence of fingers 36 enable the tamper-evident opening system of this invention to open with less force than if no fingers were present.

Further, in accordance with this invention, inner portion 26 is tightly sealed or sheathed about straw 23 after rupture and the partial return of inner portion 24 to the unstretched state. Further, while straw 23 is easily pushed into beverage container 10 after rupture, straw 23 is otherwise frictionally held by inner portion 26 in straw hole 22 at the position to which straw 23 is pushed so that straw 23 does not inadvertently fall completely into beverage container 10. In addition, as inner portion 26 ruptures, it returns to the unstretched state in a manner which seals about straw 23, inadvertent spillage of the beverage in beverage container 10 during insertion of straw 23 therein as well as afterwards about straw 23 is prevented.

In order to assure that opening system 12 is tamper-evident, it will be appreciated that the size of small pouch 38 or inner portion 26 must be restricted so that any puncture of inner portion 26 is readily evident. Thus, by limiting the overall distance D between the edge of straw hole 22 and the inner (minimum) edge of inner portion 26 to not more than twice the diameter of straw 23 and preferably not more than 1⅔ the diameter of straw 23, any slight puncture of seal strip 24 by a straw, or similar sharp object, will always be visible through straw hole 22. In other words, the unsealed area between the periphery of straw hole 22 and the inner periphery of inner portion 26 is not large enough to conceal a puncture. Typically the dimension will not exceed about 5 mm.

While the present invention has been described with respect to exemplary embodiments thereof, it will be understood by those of ordinary skill in the art that variations and modifications can be effected within the scope and spirit of the invention.

What is claimed is:

1. An opening system for a beverage container which is capable of being pierced by a straw comprising:

a container barrier wall having a straw hole therein through which the straw is designed to be inserted to draw the beverage from the container; and an easy-open tamper-evident membrane seal located inside of the container and sealingly covering the straw hole, said membrane seal being liquid impervious and including:

an outer portion which is sealed to an inside surface of said barrier wall about the straw hole and which terminates at a distance from the straw hole, said outer portion sealed to said barrier wall including fingers which extend toward the straw hole, and an inner portion integral with said outer portion which is not sealed to the inside surface and which covers the straw hole so that in use the straw pierces said inner portion after being inserted in the straw hole.

2. An opening system as claimed in claim 1 wherein said fingers form a sinusoidal intersection of said inner and outer portions about a center of said inner portion.

3. An opening system as claimed in claim 1 wherein said outer portion is substantially circular and said inner portion is centered in said outer portion.

4. An opening system as claimed in claim 1 wherein said inner portion is centered about a circular straw hole.

5. An opening system as claimed in claim 1 wherein said membrane seal is formed of a laminate of LLDPE-EVOH-LLDPE suitably laminated together.

6. An opening system as claimed in claim 5 wherein the EVOH layer is less than 40% of the thickness of the laminate, and each LLDPE layer is at least 30% of the thickness of the laminate.

7. An opening system as claimed in claim 1 wherein said distance is greater than about ⅓ the diameter of the straw and less than twice the diameter of the straw, and wherein said inner portion has a minimum edge to edge spacing taken along a line drawn through the center of the straw hole of at least three times the diameter of the straw.

8. An opening system as claimed in claim 1 wherein said distance is less than about 1¹ ⅔ the diameter of the straw.

9. An opening system as claimed in claim 1 wherein said fingers are at least 1.75 mm in length.

10. An opening system as claimed in claim 9 wherein the length of the finger is from 2 to 3.5 mm.

11. An easy-open beverage container which is capable of being pierced by a straw comprising:

a first barrier wall and a second barrier wall facing said first barrier wall;

a straw hole provided in said first barrier wall adjacent a top of the container;

an easy-open tamper-evident membrane seal located inside of the container and sealingly covering said straw hole, said membrane seal being liquid impervious and including:

an outer portion which is sealed to an inside surface of said first barrier wall about said straw hole and which terminates at a distance from said straw portion sealed to said barrier wall including fingers which extend toward a center of the hole, and an inner portion integral with said outer portion which is not sealed to the inside surface and which covers said straw hole so that a small pouch is formed by said inner portion beneath said straw hole and in use the straw pierces said inner portion after being inserted in said straw hole and into the pouch.

12. A beverage container as claimed in claim 11 wherein said membrane seal further includes a mounting strip portion integral with said outer portion and extending in opposite directions from said outer portion; and wherein said beverage container further includes an edge sealing of peripheral edges of said first barrier wall and said second barrier wall together as part of the formation of the container, said mounting strip extending to and being sealed in place by said edge sealing on respective sides of said straw hole.

13. A beverage container as claimed in claim 11 wherein said fingers form a sinusoidal intersection of said inner and outer portions about a center of said inner portion.

14. A beverage container as claimed in claim 13 wherein said outer portion is substantially circular and said inner portion is centered in said outer portion.

15. A beverage container as claimed in claim 14 wherein said inner portion is centered about a circular straw hole.

16. A beverage container as claimed in claim 15 wherein said membrane seal is formed of a laminate of LLDPE-EVOH-LLDPE suitably laminated together.

17. A beverage container as claimed in claim 16 wherein the EVOH layer is less than 40% of the thickness of the laminate, and each said LLDPE layer is at least 30% of the thickness of the laminate.

18. A beverage container as claimed in claim 17 wherein said distance is greater than about ⅓ the diameter of the straw and less than about 1⅔ the diameter of the straw, and wherein said inner portion has a minimum edge to edge spacing taken along a line drawn through the center of said straw hole of at least three times the diameter of the straw.

19. A beverage container as claimed in claim 18 wherein said fingers are at least 1.75 mm in length.

20. A beverage container as claimed in claim 19 wherein the length of the fingers is from 2 to 3.5 mm.

* * * * *